US005325777A

United States Patent [19]

Park

[11] Patent Number: 5,325,777

[45] Date of Patent: Jul. 5, 1994

[54] IMAGE FORMING APPARATUS AND METHOD

[75] Inventor: Geun-yong Park, Suwon-city, Rep. of Korea

[73] Assignee: Samsung Electronics Co., Ltd., Kyungki-do, Rep. of Korea

[21] Appl. No.: 72,009

[22] Filed: Jun. 7, 1993

[30] Foreign Application Priority Data

Aug. 6, 1992 [KR] Rep. of Korea ..... 92-14138

[51] Int. Cl.[5] ..... B41F 1/30

[52] U.S. Cl. ..... 101/409; 400/645.4; 271/277

[58] Field of Search ..... 101/409, 408, 410; 400/610.1, 610.2, 625, 645.4, 649, 659; 271/82, 277

[56] References Cited

U.S. PATENT DOCUMENTS

| | | | |
|---|---|---|---|
| 3,903,795 | 9/1975 | Suzuki | 101/409 |
| 3,937,142 | 2/1976 | Cerny et al. | 101/409 |
| 4,900,008 | 2/1990 | Fichter et al. | 101/409 |
| 4,905,985 | 3/1990 | Nagatani | 101/409 |
| 4,949,638 | 8/1990 | Watanabe | 400/185 |
| 5,092,698 | 3/1992 | Narui et al. | 101/409 |

*Primary Examiner*—Edgar S. Burr
*Assistant Examiner*—Ren Yan
*Attorney, Agent, or Firm*—Sughrue, Mion, Zinn, Macpeak & Seas

[57] ABSTRACT

An image forming apparatus includes a drum gear having a first guide slot and a cam, a clamp having a first interlocking pin inserted into the first guide slot and a cam pin is interlocked with the cam. A release lever is mounted on a support plate on which a shaft of a drum is supported. A lifter having one end with a second guide slot formed therein is coupled to the first interlocking pin. The other end of the lifter has a second interlocking pin interlocked with the release lever. The apparatus can shorten the overall printing time by reducing the additional time required for ejecting a sheet of paper because the clamp is operated in cooperation with rotation of the drum during a printing operation.

4 Claims, 3 Drawing Sheets

IMAGE FORMING APPARATUS AND METHOD

BACKGROUND OF THE INVENTION

1. Field of the Invention

The present invention relates to an image forming apparatus and method, and more particularly to an image forming apparatus which can quickly eject a sheet of paper to thereby shorten the overall printing time and a method thereof.

2. Description of the Related Art

Referring to FIG. 1, the operation of a conventional image forming apparatus will be described. When a sheet of paper 2 is fed via an inlet 1, a clamp 5 clamps the paper 2 by virtue of the biasing force of a spring 6. The clamp 5 is mounted on a bracket 4 which is rotatable about pin 4*a*. Then, as a drum 7 rotates in a counter-clockwise direction while clamping the sheet of paper 2 at a leading edge thereof, three colors, i.e., yellow, magenta and cyan, are consecutively printed on the paper. Thereafter, while ejecting the printed sheet of paper 2, the drum 7 is rotated clockwise to release the clamping of paper 2 by virtue of interaction between a cam 3 and the bracket 4. Subsequently, when the leading edge of sheet of paper 2 faces an outlet 8, drum 7 rotates counter-clockwise to force the sheet of paper out of outlet 8.

That is, in the conventional image forming apparatus constructed as above, the drum rotates clockwise upon completion of the printing to release the sheet of paper. Then, the drum rotates counter-clockwise to eject the paper. This operation requires a great deal of time to outwardly eject the paper, which in turn lengthens the overall printing time. Accordingly, the image forming apparatus of the prior art cannot print at a high speed.

SUMMARY OF THE INVENTION

It is an object of the present invention to provide an image forming apparatus and method capable of quickly ejecting a sheet of paper.

To achieve the above object, an image forming apparatus has a drum, a drum gear, provided with a first guide slot and a cam surface, installed on a rotary shaft of the drum, a clamp coupled to the rotary shaft of the drum to be rotatable and movable along radial directions of the drum. One end of the clamp has a first interlocking pin coupled to the first guide slot and the other end thereof has a cam pin which cooperates with the cam surface. A first spring imparts clamping force to the clamp and a release lever is swingable on a support plate on which the rotary shaft of the drum is supported. The release lever is biased in a counter-clockwise direction by a second spring, for releasing the clamping force of the clamp. A lifter is rotatably coupled to the rotary shaft of the drum. One end of the lifter has a second guide slot formed therein into which the first interlocking pin of the clamp is inserted, and the other end thereof has a second interlocking pin which is interlocked with the release lever.

According to the present invention having the above construction, since the sheet of paper is ejected in response to rotation of the drum while the last color is printed, the additional time required for ejecting the paper is shortened, and the overall printing time is minimized.

BRIEF DESCRIPTION OF THE DRAWINGS

The above objects and other advantage of the present invention will become more apparent by describing in detail a preferred embodiment thereof with reference to the attached drawings in which.

DETAILED DESCRIPTION OF THE PREFERRED EMBODIMENT

Figure 1:
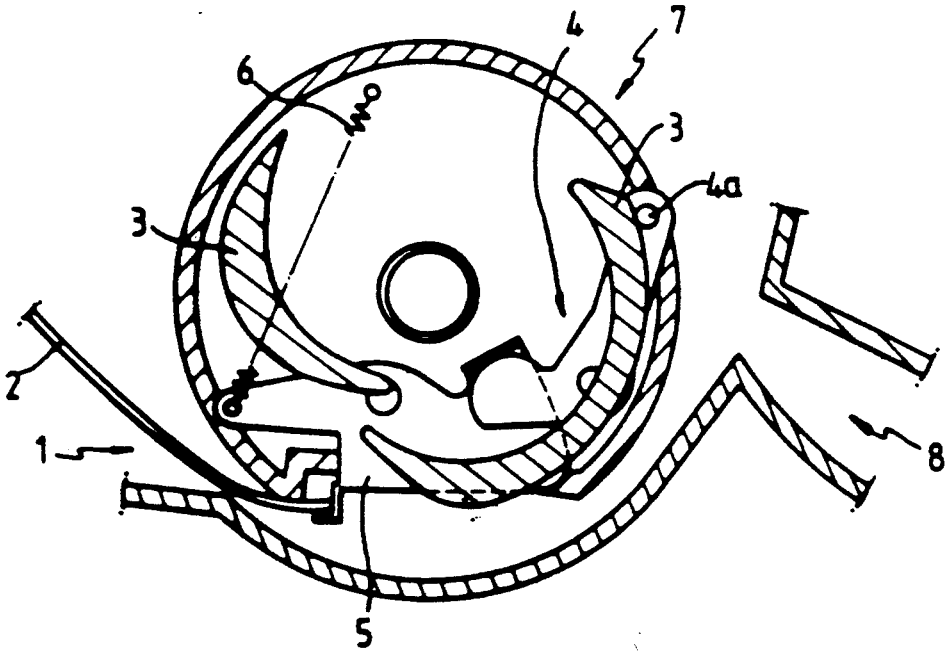
FIG.1(PRIOR ART)
FIG. 1 is a side view, in partial section, showing a conventional image forming apparatus.
Figure 2:
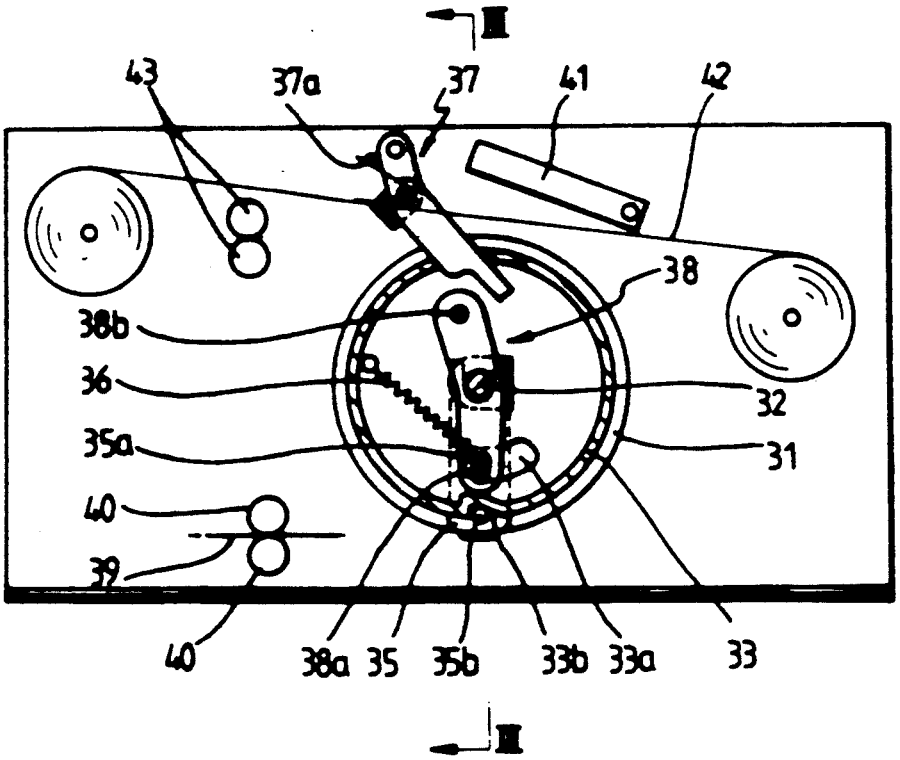
FIG. 2 is a side view, in partial section, showing am image forming apparatus according to the preferred embodiment of the present invention.
Figure 3:
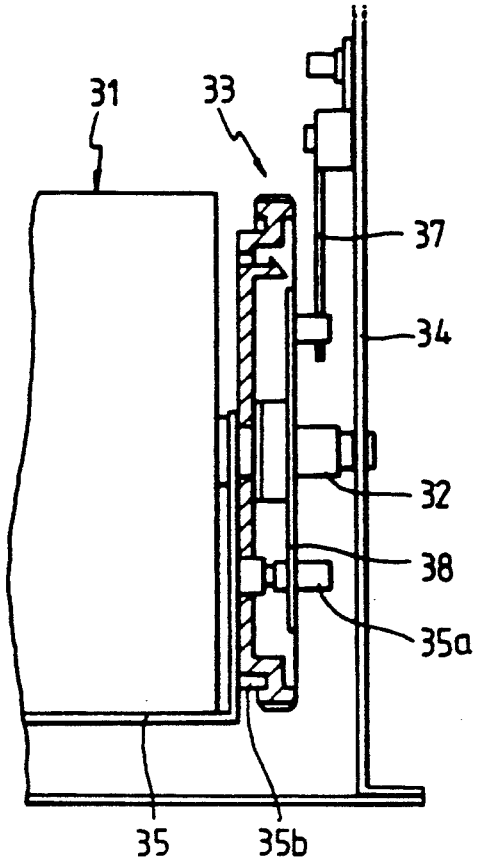
FIG. 3 is a side view, in partial section, of the preferred embodiment taken along line III—III of FIG. 2.

As shown in FIGS. 2 and 3, an image forming apparatus according to the preferred embodiment has a drum gear 33 installed concentrically with a drum 31 on a rotary shaft 32. The drum gear has a first guide slot 33*a* formed therein and a surface cam 33*b*. The rotary shaft 32 of drum 31 is rotatably supported by a support plate 34 (see FIG. 3). Also, the rotary shaft 32 is coupled to one end of a clamp 35 which has a first interlocking pin 35*a* which is inserted into first guide slot 33*a* and a cam pin 35*b* which cooperates with cam surface 33*b* of the drum gear 33. The clamp 35 can rotate about the rotary shaft 32, along with the drum 31, and move in radial directions of the drum 31. Clamp 35 is elastically biased clockwise and towards the rotary shaft 32 by the first spring 36. A release lever 37 is elastically biased counter-clockwise by a second spring 37*a* and is rotatably installed on a support plate 34. A lifter 38 is mounted in a rotatable manner on the rotary shaft 32 of the drum 31. One end of the lifter 38 has a second guide slot 38*a* which receives the first interlocking pin 35*a* of the clamp 35 and the other end thereof has a second interlocking pin 38*b* which is engageable with release the lever 37.

A paper-feed roller 40, a thermal transfer head 41, an ink-ribbon 42, and a paper-output roller 43 (see FIG. 6) are also provided in a known manner.

The operation of the preferred embodiment will be described below.

Figure 4:
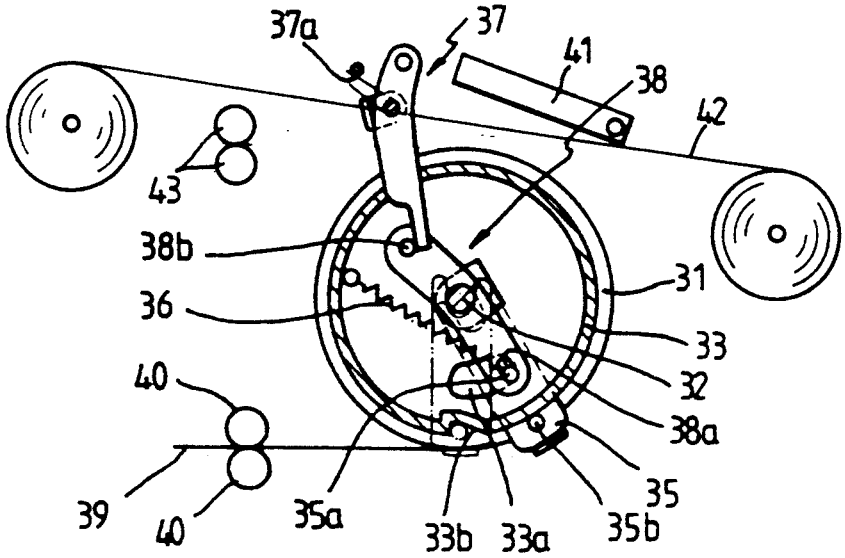
FIG. 4 is a side view, in partial section, showing the clamping operation of the apparatus shown in FIG. 2.
Figure 5:
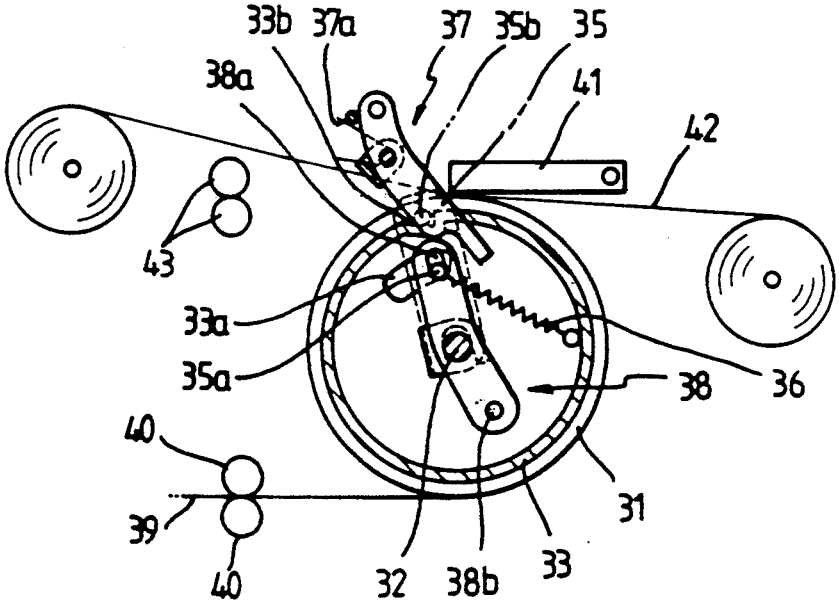
FIG. 5 is a side view, in partial section, showing the initial stage of a printing operation in the apparatus shown in FIG. 2.
Figure 6:
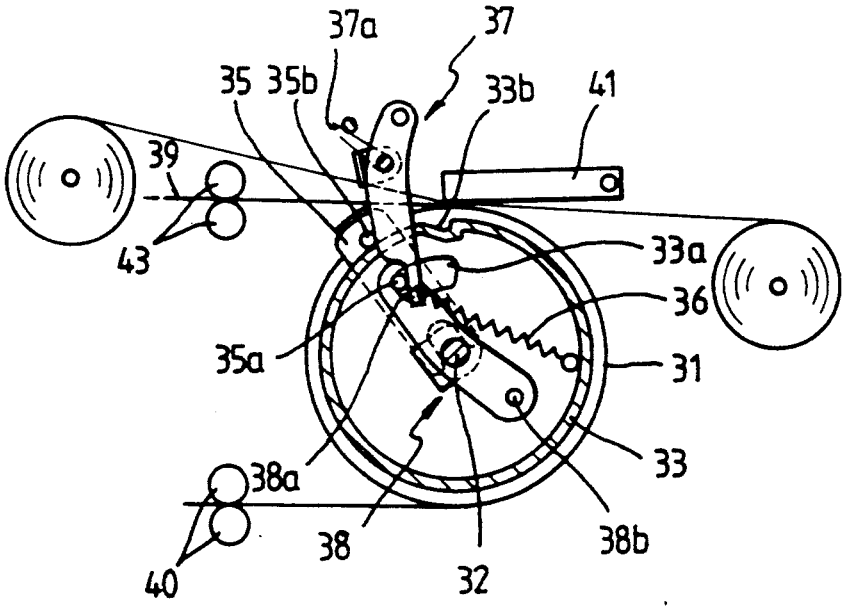
FIG. 6 is a side view, in partial section, showing the ejecting operation of the apparatus shown in FIG. 2.

Initially, the paper 39 is supplied by means of the paper feed roller 40 as shown in FIG. 2 and the release lever 37 is rotated clockwise (by a servo device, or the like) to thereby cause the second interlocking pin 38*b* of the lifter 38 to rotate counter-clockwise. Accordingly, the lifter 38 rotates counter-clockwise. Due to the counter-clockwise rotation of the lifter 38, the first interlocking pin 35*a* of the clamp 35, which is coupled to the second guide slot 38*a* of the lifter 38 also moves in a counter-clockwise direction with respect to the rotary shaft 32. By this operation, the cam pin 35*b* of the clamp 35 rides along the outer circumference of the cam surface 33*b* to cause clamp 35 to move away from the surface of the drum 31 (see solid line in FIG. 4). Upon the placement of the paper 39 at a predetermined position, release lever 37 is released and allowed to rotate in a counter-clockwise direction due to the biasing force of spring 37*a*, and the clamp 35 is released so as to fall into a position illustrated by the virtual line of FIG. 4, due to the biasing force of the first spring 36. In this position, a clamping portion of the clamp 35 presses the paper 39 against the drum 31 so that the paper 39 is clamped to the drum 31. When the clamping of the paper is completed, drum 31 rotates in a counter-clockwise direction, which transfers clamp 35 to its initial printing position as shown in FIG. 5. When the clamp 35 is transferred to the initial printing position, the thermal transfer head 41 is rotated to thus press the ink-ribbon 42 onto the paper 39. Under this state, while the drum 31 rotates in a counter-clockwise direction, two colors, e.g., yellow and magenta, are successively printed on paper 39. When the two-color printing is completed, the release lever 37 is rotated clockwise to thereby move the first interlocking pin 35*a* of the clamp 35 in a counter-clockwise direction. Thus, the clamping portion of the clamp 35 is caused to move away from the outer circumference of drum 31 while being rotated counter-clockwise because the cam pin 35*b* formed thereon slides along the cam 33*b* formed in drum gear 33, and the paper is released from a clamped state, as shown in FIG. 6. Additionally, drum 31 continues to rotate in a counter-clockwise direction, while a third color, e.g. cyan, is printed on paper 39 and the paper 39 is simultaneously ejected by the output roller 43 which is engaged with the unclamped leading edge of the paper 39.

In the image forming apparatus of the preferred embodiment as described above, the clamp is released as the color cyan, which is printed last, is printed so that the paper can be ejected during a printing operation. As a result, the additional time required for ejecting the paper is minimized as compared with the conventional apparatus wherein the paper is ejected after printing has completed, thereby enabling high-speed printing.

While the invention has been described through a preferred embodiment, it will be apparent to those skilled in the art that various modifications can be made thereto without departing from the scope and spirit of the invention as defined by the appended claims.

What is claimed is:

1. An image forming apparatus comprising:

means for printing an image on a sheet of a print medium;

a support plate;

a rotary shaft extending from said support plate;

a drum disposed on said rotary shaft;

a drum gear disposed on said rotary shaft, said drum gear having a first guide slot formed therein and a cam surface defined thereon, said cam surface having a recessed portion;

a clamp coupled to said rotary shaft to be rotatable about said shaft and movable in radial directions of said drum, a first portion of said clamp having a first interlocking pin which is slidably received in said first guide slot and a second portion of said clamp having a cam pin with which rides along said cam surface;

a first spring coupled to said clamp to bias said cam pin towards said recessed portion of said cam surface, a clamping portion of said clamp being pressed towards said drum when said cam pin is received in said recessed portion to clamp an edge of said sheet against said drum;

s second spring;

a release lever swingably mounted on said support plate and elastically biased in a first direction by said second spring; and a lifter rotatably coupled to said rotary shaft, one end of said lifter having a second guide slot in which said first interlocking pin of said clamp is also slidably received, and the other end of said lifter having a second interlocking pin which is engaged with said release lever when said drum is in a first position and said release lever is rotated in a second direction which is opposite to the first direction, to cause said lifter to rotate and thus cause said first interlocking pin to move relatively in said first guide slot to thereby move said cam pin along said cam surface and out of said recessed portion and thus cause said clamping portion of said clamp to move away from a surface of said drum to allow said edge of said sheet to be inserted therebetween.

2. An image forming apparatus as claimed in claim 1 wherein said release lever directly engages with said first interlocking pin when said drum is in a second position and said release lever is rotated in said second direction to thereby move said cam pin along said cam surface and out of said recessed portion and thus cause said clamping portion of said clamp to move away from a surface of said drum to release said edge of said sheet during a printing operation.

3. An image forming apparatus comprising:

means for printing an image on a sheet of a printing medium;

a rotatable drum for supporting said sheet;

a cam fixed to said drum, said cam having a recessed portion;

a clamp coupled to said drum to selectively clamp the sheet to said drum, said clamp having a cam pin formed thereon, said cam pin being movable along said cam to place said clamp in a clamping position when said cam pin is received in said recessed portion and to place said clamp in a released position when said cam pin is not received in said recessed portion;

a lever cooperating with said clamp to selectively move said cam pin of said clamp out of said recessed portion;

an arm rotatably attached to said drum and having a first end and a second end, said second end being connected to said clamp;

said lever pressing said first end when said drum is in a first position, which corresponds to a sheet receiving operation, and said lever being in direct contact with said clamp when said drum is in a second position, which corresponds to a printing operation.

4. An image forming apparatus as claimed in claim 3, further comprising:

an interlocking pin formed on said clamp;

said second end having a slot formed therein, said interlocking pin being received in said slot;

said lever being in contact with said interlocking pin when said drum is in said second position.

* * * * *